US010273729B2

(12) United States Patent
Webster

(10) Patent No.: US 10,273,729 B2
(45) Date of Patent: Apr. 30, 2019

(54) ANTI-LOCKING DEVICE FOR DOORS

(71) Applicant: Cory B Webster, Rancho Palos Verdes, CA (US)

(72) Inventor: Cory B Webster, Rancho Palos Verdes, CA (US)

( * ) Notice: Subject to any disclaimer, the term of this patent is extended or adjusted under 35 U.S.C. 154(b) by 504 days.

(21) Appl. No.: 15/011,345

(22) Filed: Jan. 29, 2016

(65) Prior Publication Data

US 2016/0222706 A1 Aug. 4, 2016

Related U.S. Application Data

(60) Provisional application No. 62/109,508, filed on Jan. 29, 2015.

(51) Int. Cl.
*E05C 19/00* (2006.01)
*E05C 1/04* (2006.01)
*E06B 5/10* (2006.01)

(52) U.S. Cl.
CPC ..... *E05C 19/003* (2013.01); *E05C 1/04* (2013.01); *E06B 5/10* (2013.01)

(58) Field of Classification Search
CPC ... Y10T 16/61; Y10T 16/6285; Y10T 292/28; Y10T 16/628; Y10T 292/65; Y10T 16/27; Y10T 16/629; Y10T 16/540295; Y10T 16/5513; Y10T 16/6295; E05Y 2201/224; E05F 2005/046; E05F 5/02; E05F 5/06; Y10S 292/15; Y10S 16/17; E05B 17/2084
See application file for complete search history.

(56) References Cited

U.S. PATENT DOCUMENTS 1,740,329 A * 12/1929 Broadstone ..... E05F 5/027 16/83
2,223,396 A * 12/1940 Westeamp ..... E05F 5/027 292/71
3,055,043 A * 9/1962 Luttner, Jr. ..... E05F 5/04 16/86 B
5,123,685 A * 6/1992 Donovan ..... E05C 17/04 16/82
5,125,695 A * 6/1992 Hartwell ..... E05B 15/101 292/62
8,276,240 B2 * 10/2012 Ritachka ..... E05F 5/02 16/82
2005/0241238 A1 * 11/2005 Garvey ..... E05F 5/04 49/383
2008/0224484 A1 * 9/2008 Yates ..... E05C 17/54 292/262

(Continued)

*Primary Examiner* — Mark A Williams
(74) *Attorney, Agent, or Firm* — Cislo & Thomas, LLP

(57) ABSTRACT

An anti-locking device comprising a body with an inverted U-shaped channel wherein a T-shaped rod sits and can move laterally when rotated at certain configurations within the U-shaped channel, such that the T-shaped rod can move from an obstructing configuration and to an non-obstruction configuration, and vice versa. The anti-locking device is preferably attachable to a hinged door and the T-shaped rod is able to move laterally in the body of the anti-locking device. In an obstructing configuration, one end of the T-shaped rod would sit between a door and its corresponding doorframe to keep the door from closing, and in a non-obstructing configuration, the T-shaped rod would not sit between the door and the doorframe, allowing the door to close.

13 Claims, 6 Drawing Sheets

(56) References Cited

U.S. PATENT DOCUMENTS

| | | | | |
|---|---|---|---|---|
| 2012/0223535 | A1* | 9/2012 | Yates | E05C 17/54<br>292/288 |
| 2014/0084605 | A1* | 3/2014 | Packer | E05C 17/54<br>292/343 |
| 2015/0091313 | A1* | 4/2015 | Braselton | E05C 17/50<br>292/342 |

* cited by examiner

ANTI-LOCKING DEVICE FOR DOORS

CROSS-REFERENCE TO RELATED APPLICATION

This patent application claims the benefit of U.S. Provisional Patent Application Ser. No. 62/109,508, entitled "Anti-Locking Device for Doors," filed Jan. 29, 2015, which application is incorporated in its entirety here by this reference.

TECHNICAL FIELD

This invention relates to an anti-locking device for doors.

BACKGROUND ART

In light of recent tragic shootings at schools, public safety officials have been re-evaluating their lockdown protocols and schools have been advised, if not legally mandated already, to keep doors locked during instructional times and when doors are not actively used. However, practically speaking, to lock and unlock doors a handful of times each day is inefficient and burdensome for teachers.

In an active shooter situation, doors at schools need to be locked in no more than 5 seconds. Schools also need gadgets that can be retrofitted with existing doors so that doors are not required to be replaced for financial and practical reasons. Furthermore, public schools, for example, most likely cannot afford any of the high-tech gadgets that assist with locking and unlocking doors that are available today.

Typically, doors are locked at the handle or knob and require a physical turning of a key to change between a locked and unlocked configuration. Thus, an efficient method of providing a safe environment would be to keep the door itself locked while providing another simple manual option for keeping the door open.

Further, given that the average person has many keys on a keychain, it may take a significant amount of time to manually lock or unlock a door. Thus, there are many other circumstances when a locked door needs to be held open but preferably not by a doorstopper that could unintentionally be pushed aside and result in an accidental lockout.

Therefore, there has been a growing need, inside and outside the classroom, for a device that provides a simple foolproof anti-locking functionality for doors that does not require one to change a locked configuration of the door itself.

SUMMARY OF INVENTION

The present invention is an anti-locking device that comprises a body with an inverted U-shaped channel wherein a T-shaped rod sits and can move laterally when rotated at certain configurations within the inverted U-shaped channel, such that the T-shaped rod can transition from a locking configuration to a non-locking configuration, and vice versa.

The anti-locking device is preferably attachable to a door while the T-shaped rod is able to move laterally in the inverted U-shaped channel of the body of the anti-locking device. In the preferred embodiment, in an obstructing configuration, one end of the T-shaped rod would sit between a door and its corresponding doorframe to keep the door from closing, and in a non-obstructing configuration, the T-shaped rod would not sit between the door and the doorframe, allowing the door to close.

Provided most public doors open outwardly due to safety reasons for evacuation purposes, the present invention utilizes such a configuration to its advantage such that it may be attached to the door on the inside and consequently would not require one to reach a hand out the door to lock or unlock. However, the present invention may also be attached on the outside of the doors for doors that open inwardly, which are typically doors in more private settings. Further, the present invention may also be attached on doorframes, functioning in the same manner such that the T-shaped rod would sit between the door and the doorframe in an obstructing configuration. Thus, the present invention provides not only a simple foolproof solution for active shooter situations in public settings but also other less hostile situations for keeping a locked door open without unlocking the door itself.

DETAILED DESCRIPTION

The detailed description set forth below in connection with the drawings is intended as a description of presently-preferred embodiments of the invention and is not intended to represent the only forms in which the present invention may be constructed or utilized.

Figure 1:
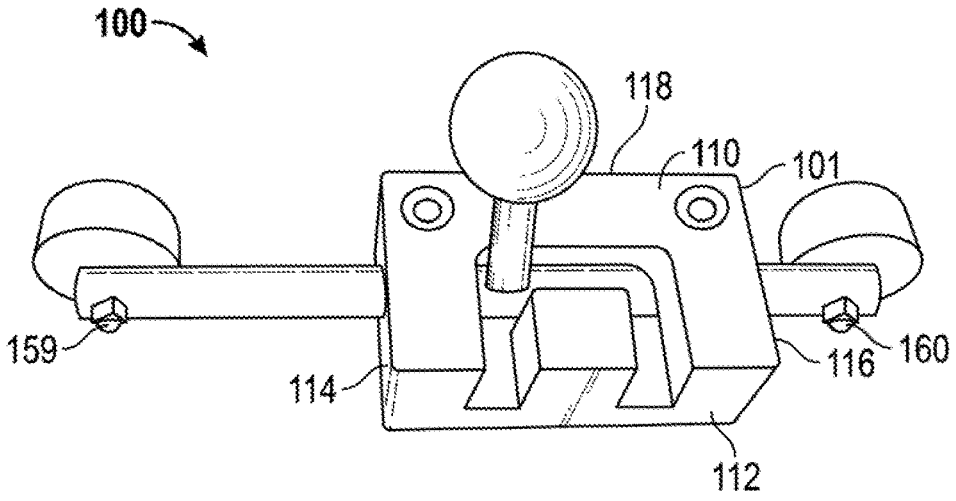
FIG. 1 is a perspective view of an embodiment of the present invention in a first disengaged configuration.

Referring to FIG. 1, shown is an anti-locking device 100 that can be used in the implementation of the present invention, wherein the anti-locking device 100 comprises a body 101 and a T-shaped rod 134 configured to sit in and move through a channel 124 in the body 101. The anti-locking device 100 of the present invention may be attached to a door, preferably a hinged door, or a doorframe, such that if the anti-locking device 100 is in an obstructing configuration, a portion of the T-shaped rod 134 would sit between a door and its corresponding doorframe, preventing the door from closing. The T-shaped rod 134 may be moved to a non-obstructing configuration, such that the T-shaped rod 134 would no longer sit between the door and its corresponding doorframe, allowing the door to close.

Figure 7A:
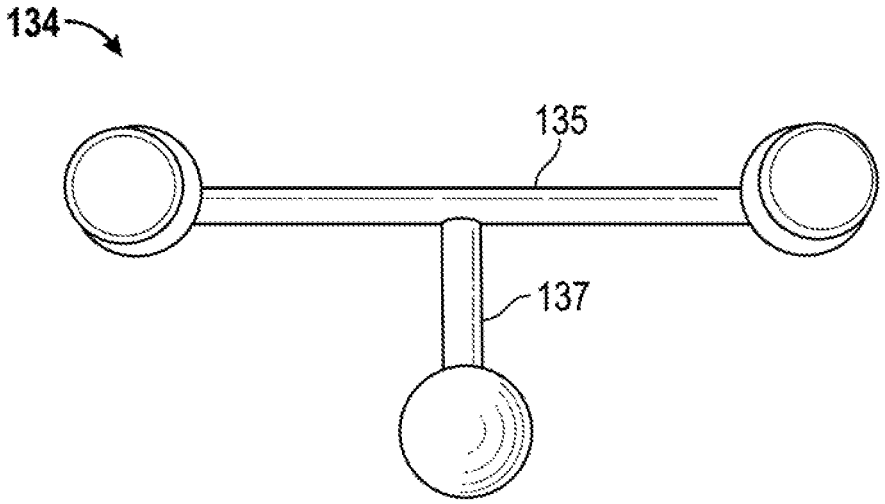
FIG. 7A is a top view of an assembled T-shaped rod.
Figure 7B:
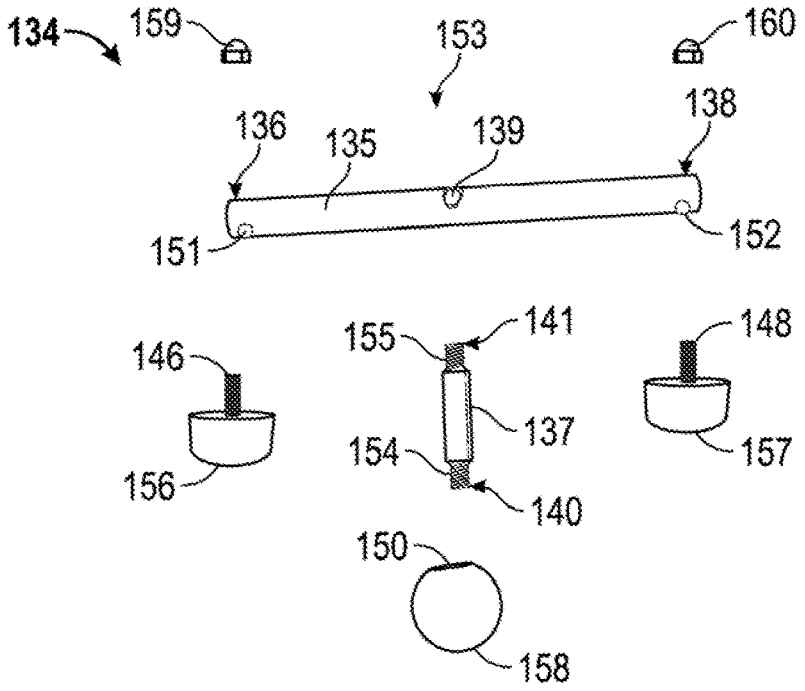
FIG. 7B is a top view of a disassembled T-shaped rod.

The T-shaped rod 134, best shown in FIGS. 7A and 7B, comprises a first rod 135 and a second rod 137, perpendicular to and attachable to the first rod 135. The T-shaped rod 134 is configured to sit inside the channel 124 of the body 101 of the anti-locking device 100, such that the first rod 135 can extend through a portion of the channel 124 of the body 101 of the anti-locking device 100 and extend out of the body 101 through a first hole 130 and a second hole 132. The first rod 135 of the T-shaped rod 134 further comprises a first bumper 156 and a second bumper 157 at a first end 136 and a second end 138 of the first rod 135, respectively. Provided that the first rod 135 represents a first axis, the first bumper 156 and the second bumper 157 are configured to be perpendicular to the first axis, and are parallel to and offset of one another. The second rod 137 sits in between the first bumper 156 and the second bumper 157, is also perpendicular to the first axis, and aligned skew to the first bumper 156 and the second bumper 157. The first bumper 156 and the second bumper 157 may be further secured on the first rod 135 via a first cap nut 159 and a second cap nut 160, respectively. When the T-shaped rod 134 is in the obstructing configuration, the first bumper 156 and the second bumper 157 are the first points of contact between the anti-locking device 100 and a door or a doorframe, which helps avoid any damage to the door or doorframe. In the preferred embodiment, the first bumper 156 and the second bumper 157 are made of nonabrasive material, preferably rubber-like, which would minimize damage from any constant contact.

Figure 8:
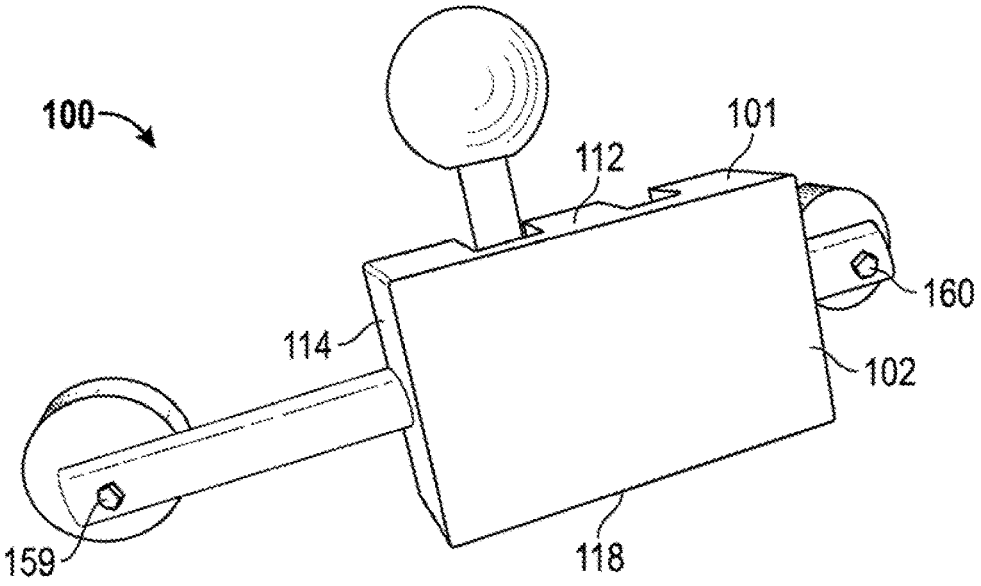
FIG. 8 is a back perspective view of the embodiment in FIG. 1 in a first engaged configuration.

FIG. 1 shows a preferred embodiment of the anti-locking device 100 comprising a body 101 with a base side 102 (best shown in FIG. 8); a first sidewall 112 perpendicularly adjacent to the base side 102; a second sidewall 114 perpendicularly adjacent to the first sidewall 112 and the base side 102; a third sidewall 116 perpendicularly adjacent to the base side 102 and first sidewall 112, and parallel to and opposite of the second sidewall 114; a fourth sidewall 118 perpendicularly adjacent to the base side 102, the second sidewall 114, and the third sidewall 116, and parallel to and opposite of the first sidewall 112; and a top side 110 perpendicularly adjacent to the first sidewall 112, the second sidewall 114, the third sidewall 116, and the fourth sidewall 118, and parallel to and opposite of the base side 102.

Figure 2:
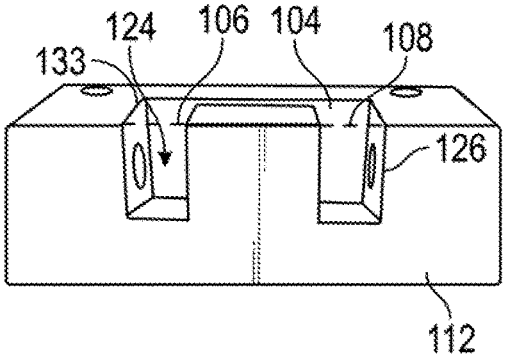
FIG. 2 is a front perspective view of the embodiment in FIG. 1 without a T-shaped rod.
Figure 3:
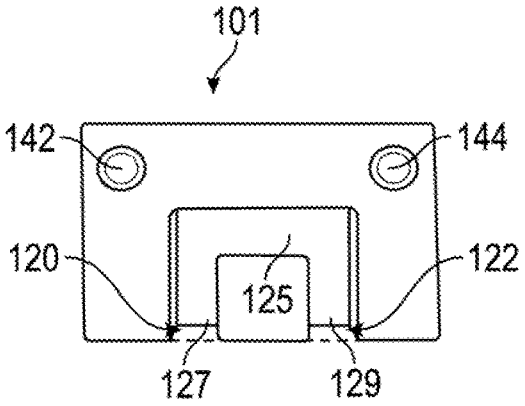
FIG. 3 is a top view of the embodiment in FIG. 1 without a T-shaped rod.

As shown in FIG. 2, on the top side 110, there is an opening 104, preferably an inverted U-shaped opening. In the preferred embodiment, the opening 104 extends to the first sidewall 112 at a first end 106 and a second end 108 of the opening 104, such that a first opening 120 and a second opening 122 are formed on the first sidewall 112, contiguous to the first end 106 and second end 108 of the opening 104 on the top side 110, respectively. The opening 104 on the top side 110 and the first opening 120 and second opening 122 on the first sidewall 112 are contiguous to the channel 124, defined by at least one internal wall 126. In the preferred embodiment, the channel 124 is an inverted U-shaped channel. As shown in FIG. 3, in the preferred embodiment, the at least one internal wall 126 creates a horizontal portion 125, a first vertical portion 127 and a second vertical portion 129, and meets the inverted U-shaped opening 104 at an edge 133 (best shown in FIG. 2).

Figure 4:
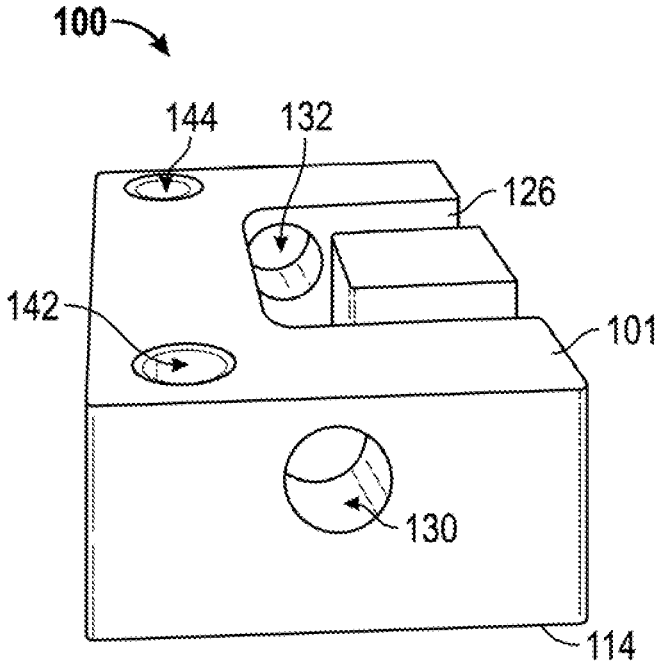
FIG. 4 is a left perspective view of the embodiment in FIG. 1 without a T-shaped rod.
Figure 5:
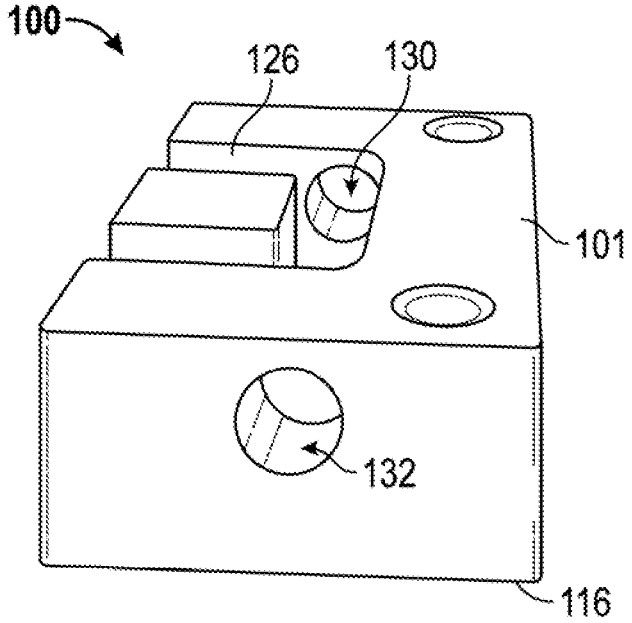
FIG. 5 is a right perspective view of the embodiment in FIG. 1 without a T-shaped rod.
Figure 6:
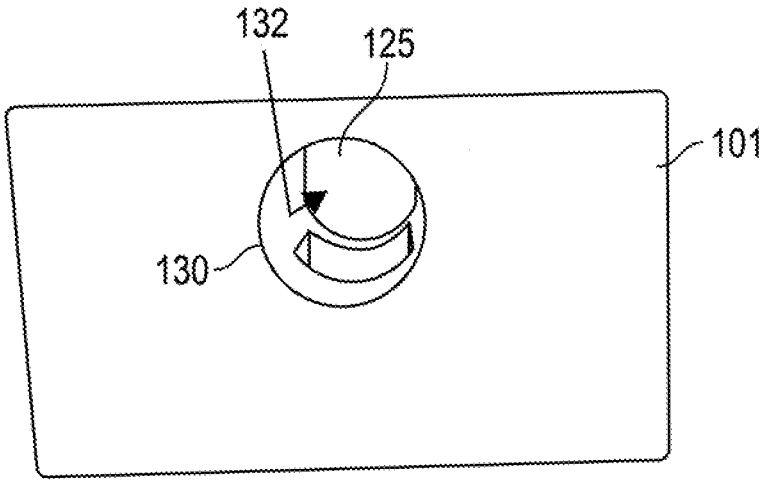
FIG. 6 is a left view of the embodiment in FIG. 1 without a T-shaped rod.

As shown in FIGS. 4 and 5, in the preferred embodiment, the first hole 130 lies in the second sidewall 114 and extends through the body 101 of the anti-locking device 100. A second hole 132 lies in the third sidewall 116, extends through the body 101 of the anti-locking device 100, and is concentrically aligned to the first hole 130. The first hole 130 and the second hole 132 meet the inverted U-shaped channel 124 and are configured to align with the horizontal channel 125 of the U-shaped channel 124 (best shown in FIG. 6). In a preferred embodiment, a third hole 142 and a fourth hole 144 run from the top side 110 to the base side 102 through the anti-locking device 100, so that the anti-locking device 100 is attachable, preferably with screws, to a door or the like.

In a preferred embodiment, the first bumper 156 and the second bumper 157 may be removeably attached to the first end 136 and the second end 138 of the first rod 135, respectively, such that the first bumper 156 and the second bumper 157 comprises a first fastener 146 and a second fastener 148, respectively, and the first rod 135 comprises a first reciprocal fastener 151 at the first end 136 and a second reciprocal fastener 152 at the second end 138.

Also in the preferred embodiment, the second rod 137, having a first end 140 and a second end 141 with a third fastener 154 and a fourth fastener 155, respectively, may be removeably attached to the first rod 135, having a center 153 with a fourth reciprocal fastener 139, wherein the fourth reciprocal fastener 139 is removeably attached to the fourth fastener 155. Further, a knob 158, having a third reciprocal fastener 150, may be removeably attached to the third fastener 154 on the first end 140 of the second rod 137.

When the T-shaped rod 134 is assembled in the preferred embodiment, the first reciprocal fastener 151 engages with the first fastener 146, the second reciprocal fastener 152 engages with the second fastener 148, the third reciprocal fastener 150 engages with the third fastener 154, the fourth reciprocal fastener 139 engages with the fourth fastener 155. Preferably, the first reciprocal fastener 151, the second reciprocal fastener 152, the third reciprocal fastener 150, and the fourth reciprocal fastener 139 are threaded holes, and the first fastener 146, the second fastener 148, the third fastener 154, and the fourth fastener 155 are threaded screws.

Alternatively, the first bumper 156, the second bumper 157, and the second rod 137 may be removeably attached to the first rod 135 and the knob 158 may be removeably attached to the second rod 137 via other means such as snaps, hook and loop fasteners, magnets, or other suitable attachment means of engineering choice. Also, the anti-locking device 100 may comprise only the first bumper 156 or only the second bumper 157, such that anti-locking device 100 is uni-directional and may also be integrally formed (e.g. plastic).

Figure 9:
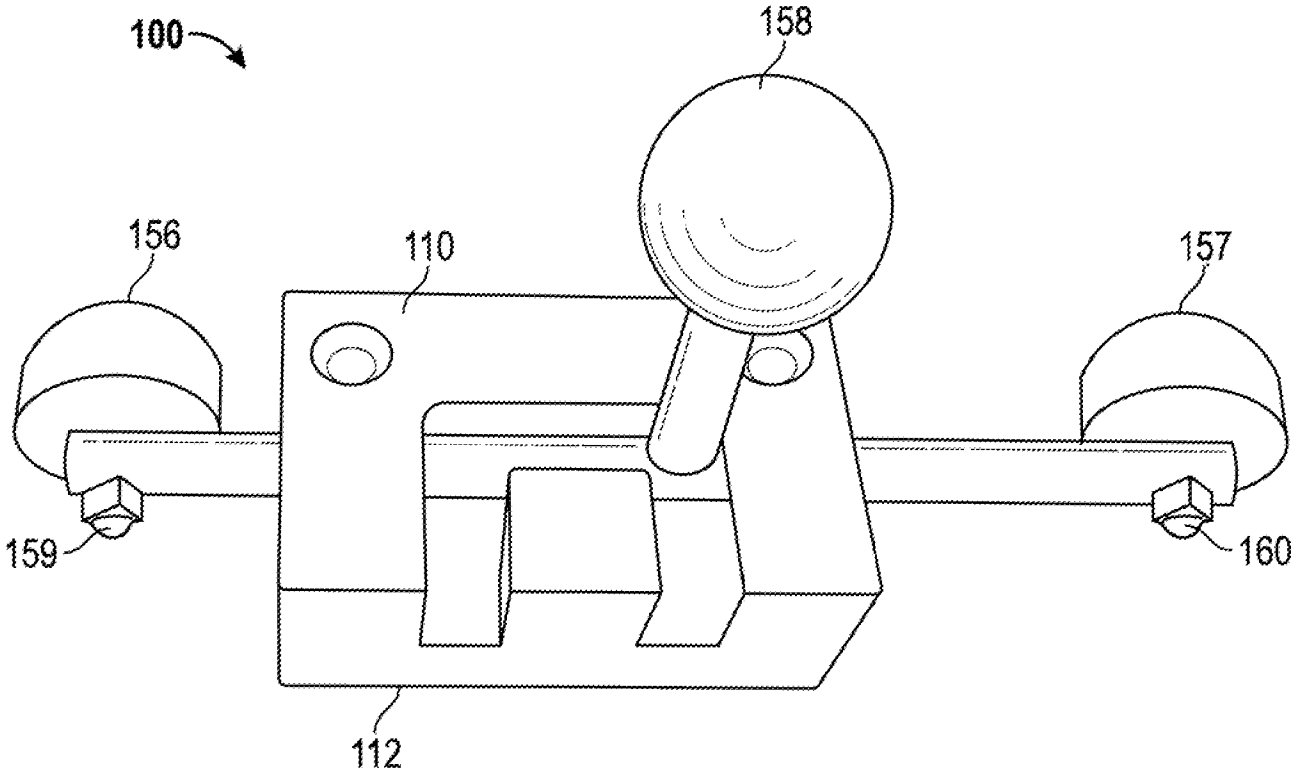
FIG. 9 is a perspective view of the embodiment in FIG. 1 in a second disengaged configuration with cap nuts removed.
Figure 10:
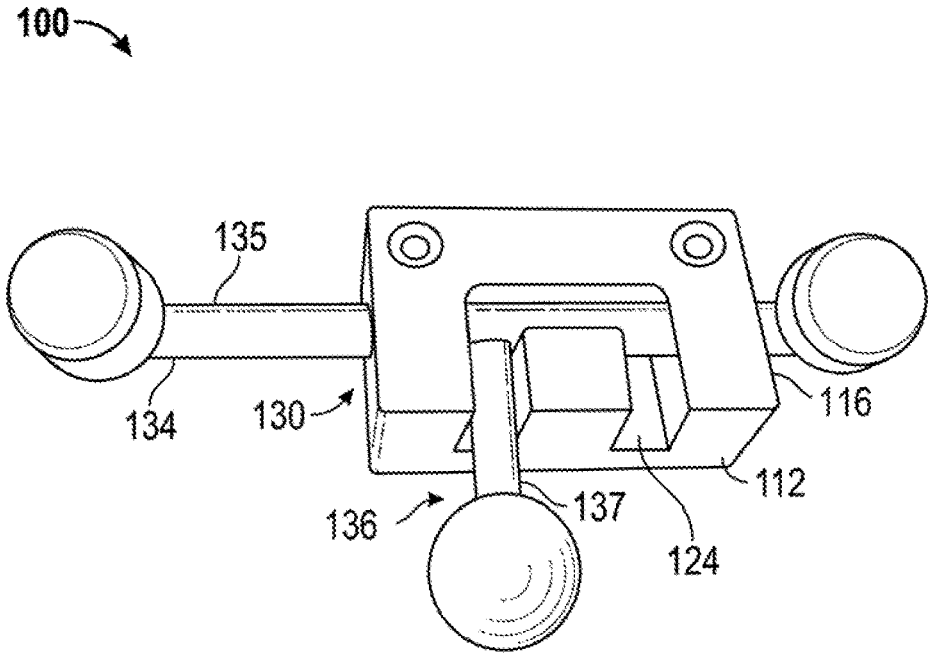
FIG. 10 is a perspective view of the embodiment in FIG. 1 in the first engaged configuration.
Figure 11:
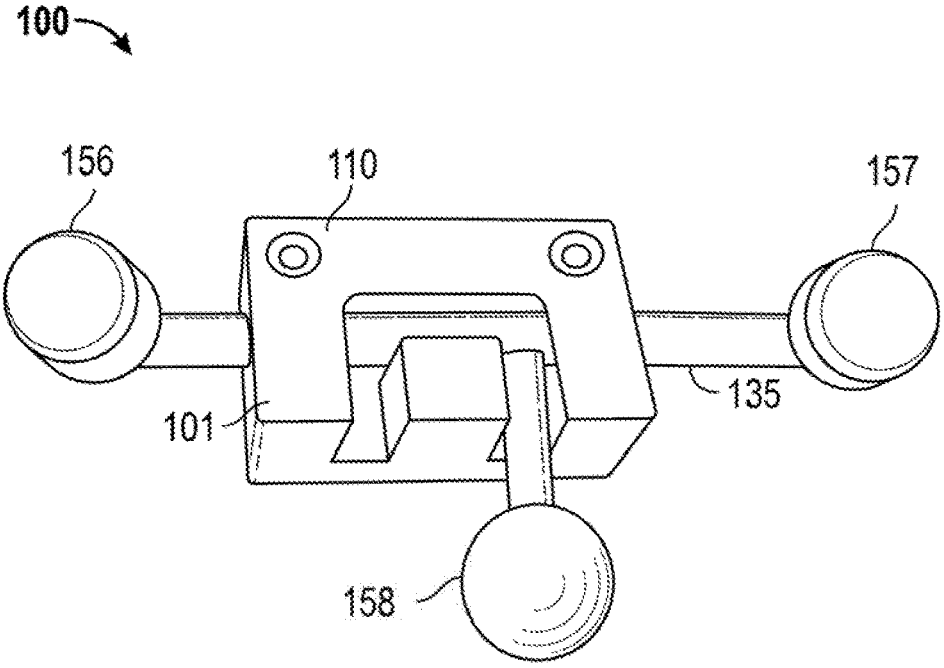
FIG. 11 is a perspective view of the embodiment in FIG. 1 in a second engaged configuration.

In operation, the T-shaped rod 134 can slide laterally whenever the T-shaped rod 134 is rotated about a longitudinal axis that is parallel to the horizontal portion 125 of the inverted U-shaped channel 124, to disengaged configurations as shown in FIGS. 1 and 9. Once disengaged, the T-shaped rod 134 may slide laterally along the horizontal portion 125 of the inverted U-shaped channel 124 towards the second sidewall 114 to be in a first disengaged configuration (see FIG. 1) or toward the third sidewall 116 to be in a second disengaged configuration (see FIG. 9). Then, the T-shaped rod 134 may be rotated back about the longitudinal axis to an engaged configuration into the inverted U-shaped channel 124, such that second rod 137 of the T-shaped rod 134 may sit in the first vertical portion 127 to be in a first engaged configuration (see FIG. 10) or the second vertical portion 129 to be in a second engaged configuration (see FIG. 11). Depending on if the door swings inward or outward and if the anti-locking device 100 is secured on a door or a doorframe, the first engaged configuration and the second engaged configuration may be either the obstructing configuration and the non-obstructing configuration, or vice versa.

The anti-locking device 100 may be manufactured through fabricated metal product manufacturing through methods, including but not limited to, forging, stamping, bending, forming, welding, machining, and assembly. The anti-locking device 100 may also be manufactured through other rigidly sturdy materials such as plastic, wood, etc.

Several of the features and functions disclosed above may be combined into different systems and applications, or combinations of systems and applications. Various presently unforeseen or unanticipated alternatives, modifications, variations or improvements therein may be subsequently made by those skilled in the art, each of which is also intended to be encompassed by the following claims.

What is claimed is:

1. An anti-locking device, comprising:

a. a body, comprising:

i. a base side;

ii. a first sidewall perpendicularly adjacent to the base side, wherein the first sidewall comprises a first and second opening;

iii. a second sidewall perpendicularly adjacent to the first sidewall and the base side, wherein the second sidewall comprises a first hole;

iv. a third sidewall, perpendicularly adjacent to the base side, first sidewall, and parallel to and opposite of the second sidewall, wherein the third sidewall comprises a second hole;

v. a fourth sidewall, perpendicularly adjacent to the base side, the second sidewall, and the third sidewall, and parallel to and opposite of the first sidewall; and vi. a top side perpendicularly adjacent to the first sidewall, the second sidewall, the third sidewall, and the fourth sidewall, and parallel to and opposite of the base side, the top side comprising an inverted U-shaped opening, comprising a first end and a second end;

vii. an inverted U-shaped channel, defined by at least one internal wall creating a horizontal portion, a first vertical portion, and a second vertical portion, such that the internal wall meets the inverted U-shaped opening at an edge; and viii. a third and fourth hole that extend from the top side to the base side through the body, ix. wherein the first hole in the second sidewall and the second hole in the third sidewall respectively extend through the body of the anti-locking device, meeting the horizontal portion of the inverted U-shaped channel, such that the first hole and the second hole are concentrically aligned;

b. a T-shaped rod, comprising:

i. a first rod having a first end with a first reciprocal fastener, a second end with a second reciprocal fastener, and a center with a fourth reciprocal fastener;

ii. a second rod, having a first end with a third fastener and a second end with a fourth fastener, wherein the fourth fastener of the second rod is engageable to the fourth reciprocal fastener member at the center of the first rod;

iii. a first bumper having a first fastener engageable to the first reciprocal fastener on the first end of the first rod;

iv. a second bumper having a second fastener engageable to the second reciprocal fastener on the second end of the first rod;

v. a first cap nut and a second cap nut secure the first bumper and the second bumper on the first rod, respectively;

vi. a knob, having a third fastener, engageable to the third reciprocal fastener on the first end of the second rod; and vii. wherein the T-shaped rod is configured to sit inside the inverted U-shaped channel, such that the first rod extends through the first hole, the horizontal channel of the U-shaped channel, and the second hole of the body of the anti-locking device, c. wherein the inverted U-shaped opening extends to the first sidewall at the first end and second end of the inverted U-shaped opening, such that the first opening and the second opening on the first sidewall are contiguous with the first end and second end of the inverted U-shaped opening, respectively, d. wherein the inverted U-shaped opening on the top side and the first and second openings on the first sidewall are contiguous to the inverted U-shaped channel, e. wherein, provided that the first rod represents a first axis, the first bumper and the second bumper are configured to be perpendicular to the first axis, and are parallel to and offset of one another, f. wherein the second rod sits in between the first bumper and the second bumper, is also perpendicular to the first axis, and aligned skew to the first bumper and the second bumper, and g. wherein the first and second bumpers are made of nonabrasive material.

2. An anti-locking device, comprising:

a. a body, comprising:

i. a first hole;

ii. a second hole, concentrically aligned with the first hole;

iii. a channel, defined by at least one internal wall;

iv. a base side;

v. a first sidewall, perpendicularly adjacent to the base side, wherein the first sidewall comprises a first and second opening;

vi. a second sidewall perpendicularly adjacent to the first sidewall and the base side, wherein the second sidewall comprises the first hole;

vii. a third sidewall, perpendicularly adjacent to the base side, first sidewall, and parallel to and opposite of the second sidewall, wherein the third sidewall comprises the second hole;

viii. a fourth sidewall, perpendicularly adjacent to the base side, the second sidewall, and the third sidewall, and parallel to and opposite of the first sidewall; and ix. a top side, perpendicularly adjacent to the first sidewall, the second sidewall, the third sidewall, and the fourth sidewall, and parallel to and opposite of the base side, the top side comprising a third opening that is contiguous with the channel, wherein the third opening is an inverted U-shape opening comprising a first end and a second end, such that the inverted U-shaped opening extends to the first sidewall at the first end and the second end of the inverted U-shaped opening, contiguous with the first opening and the second opening on the first sidewall, respectively, wherein the channel is an inverted U-shape channel comprising a horizontal portion, a first vertical portion, and a second vertical portion, such that the at least one internal wall meets the inverted U-shaped opening at an edge of the inverted U-shaped opening, wherein the portion of the inverted U-shape channel that the first hole and second hole are concentrically aligned with is the horizontal portion of inverted U-shape channel, and wherein the first hole and the second hole respectively extend through the body of the anti-locking device, meeting the channel, such that the first hole and second hole are concentrically aligned with a portion of the channel; and b. a T-shaped rod, comprising:

i. a first rod, having a first end with a first bumper, a second end with a second bumper, and a center; and ii. a second rod having a first end and a second end, wherein the second end of the second rod attaches perpendicularly to the first rod, c. wherein the T-shaped rod is configured to sit inside the channel, such that the first rod extends through the first hole, a portion of the channel, and the second hole of the body of the anti-locking device.

3. The anti-locking device of claim 2, wherein, provided that the first rod represents a first axis, the first bumper and the second bumper are configured to be perpendicular to the first axis, and are parallel to and offset of one another, and the second rod sits in between the first bumper and the second bumper, is also perpendicular to the first axis, and aligned skew to the first bumper and the second bumper.

4. The anti-locking device of claim 2, wherein a first cap nut and a second cap nut secure the first bumper and the second bumper on the first rod, respectively.

5. The anti-locking device of claim 2, wherein a third and fourth hole extend from the top side to the base side through the body.

6. An anti-locking device, comprising:

a. a body, comprising:

i. a first hole;

ii. a second hole, concentrically aligned with the first hole;

iii. a channel, defined by at least one internal wall, wherein the first hole and the second hole respectively extend through the body of the anti-locking device, meeting the channel, such that the first hole and second hole are concentrically aligned with a portion of the channel;

b. a T-shaped rod, comprising:

i. a first rod, having a first end with a first bumper, a second end with a second bumper, and a center; and ii. a second rod having a first end and a second end, wherein the second end of the second rod attaches perpendicularly to the first rod, wherein the T-shaped rod is configured to sit inside the channel, such that the first rod extends through the first hole, a portion of the channel, and the second hole of the body of the anti-locking device, wherein the first end of the first rod comprises a first reciprocal fastener that is removeably attachable to a first fastener of the first bumper, the second end of the first rod comprises a second reciprocal fastener that is removeably attachable to a second fastener of the second bumper, the center of the first rod comprises a fourth reciprocal fastener, the first end of the second rod comprises a third fastener that is removeably attachable to a third reciprocal fastener of the third knob, and the second end of the second rod comprises a fourth fastener that is removeably attachable to the fourth reciprocal fastener at the center of the first rod.

7. The anti-locking device of claim 6, wherein, provided that the first rod represents a first axis, the first bumper and the second bumper are configured to be perpendicular to the first axis, and are parallel to and offset of one another, and the second rod sits in between the first bumper and the second bumper, is also perpendicular to the first axis, and aligned skew to the first bumper and the second bumper.

8. The anti-locking device of claim 6, wherein a first cap nut and a second cap nut secure the first bumper and the second bumper on the first rod, respectively.

9. The anti-locking device of claim 6, wherein a third and fourth hole extend from the top side to the base side through the body.

10. The anti-locking device of claim 6, wherein the body further comprises:

a. a base side;

b. a first sidewall, perpendicularly adjacent to the base side, wherein the first sidewall comprises a first and second opening;

c. a second sidewall perpendicularly adjacent to the first sidewall and the base side, wherein the second sidewall comprises the first hole;

d. a third sidewall, perpendicularly adjacent to the base side, first sidewall, and parallel to and opposite of the second sidewall, wherein the third sidewall comprises the second hole;

e. a fourth sidewall, perpendicularly adjacent to the base side, the second sidewall, and the third sidewall, and parallel to and opposite of the first sidewall; and f. a top side, perpendicularly adjacent to the first sidewall, the second sidewall, the third sidewall, and the fourth sidewall, and parallel to and opposite of the base side, comprising a third opening that is contiguous with the channel.

11. The anti-locking device of claim 10, wherein the third opening is an inverted U-shape opening comprising a first end and a second end, such that the inverted U-shaped opening extends to the first sidewall at the first end and second end of the inverted U-shaped opening, contiguous to the first opening and the second opening on the first sidewall, respectively.

12. The anti-locking device of claim 11, wherein the channel is an inverted U-shape channel comprising a horizontal portion, a first vertical portion, and a second vertical portion, such that the at least one internal wall meets the inverted U-shaped opening at an edge of the inverted U-shaped opening.

13. The anti-locking device of claim 12, wherein the portion of the inverted U-shape channel that the first hole and second hole are concentrically aligned with is the horizontal portion of inverted U-shape channel.

* * * * *